US008906290B2

(12) United States Patent
Klikovich et al.

(10) Patent No.: US 8,906,290 B2
(45) Date of Patent: Dec. 9, 2014

(54) METHOD FOR EXCHANGEABLY FASTENING A REFRACTORY PURGE PLUG OR SLEEVE

(75) Inventors: Michael Klikovich, Hinterbrühl (AT); Leopold Kneis, Grimmenstein (AT)

(73) Assignee: Stopinc Aktiengesellschaft, Hunenberg (CH)

( * ) Notice: Subject to any disclaimer, the term of this patent is extended or adjusted under 35 U.S.C. 154(b) by 668 days.

(21) Appl. No.: 13/128,938

(22) PCT Filed: Nov. 17, 2009

(86) PCT No.: PCT/EP2009/008180
§ 371 (c)(1), (2), (4) Date: Jun. 17, 2011

(87) PCT Pub. No.: WO2010/054853
PCT Pub. Date: May 20, 2010

(65) Prior Publication Data

US 2011/0241268 A1 Oct. 6, 2011

(30) Foreign Application Priority Data

Nov. 17, 2008 (CH) ..... 01801/08

(51) Int. Cl.
*C21B 7/12* (2006.01)
*C21C 5/48* (2006.01)

(52) U.S. Cl.
USPC ..... 266/45; 266/47; 266/236; 266/272; 222/591

(58) Field of Classification Search
USPC ..... 266/45, 271–273, 47, 236; 222/591
See application file for complete search history.

(56) References Cited

U.S. PATENT DOCUMENTS 5,249,811 A * 10/1993 Bruckner et al. ..... 277/314

FOREIGN PATENT DOCUMENTS

JP 62-185822 * 7/1987 ..... C23C 7/072

* cited by examiner

*Primary Examiner* — Lois Zheng
(74) *Attorney, Agent, or Firm* — Brian Roffe

(57) ABSTRACT

A container for molten metal has at least one opening in which a refractory nozzle brick is mounted. A refractory purge plug or a refractory sleeve defining an outlet opening is inserted in the nozzle brick opening. A defined gap is formed between the nozzle brick opening and the purge plug or the sleeve and is filled with a refractory mass, this mass consisting of a material which can be easily bored or milled out of the mass for the purpose of replacing the purge plug or the sleeve. In this manner, laborious cleaning steps can be avoided and the nozzle brick no longer risks being damaged.

10 Claims, 3 Drawing Sheets

METHOD FOR EXCHANGEABLY FASTENING A REFRACTORY PURGE PLUG OR SLEEVE

FIELD OF THE INVENTION

The invention relates to a method for mounting and removing a refractory purge plug or a refractory sleeve in or from a refractory nozzle brick mounted in a container for molten metal, and a container for molten metal for implementation of the method.

BACKGROUND OF THE INVENTION

Till now conical refractory purge plugs (purge sleeves), by means of which gas is introduced into the molten metal, or conical refractory sleeves, which respectively form an outlet opening, are generally inserted into correspondingly formed nozzle brick openings. They are separated from the latter by narrow mortar joints (approximately 1 to 3 mm wide). When the worn purge plugs or sleeves break loose, which happens due to pulling, chiselling out using pneumatic hammers, burning out, squeezing out etc., these parts are time and again destroyed, the remains being left hanging in the respective nozzle brick opening. These remains, as well as mortar remains and any steel tongues, must be removed, which is very labour-intensive. When they break loose, and during the cleaning steps, damage to or destruction of the nozzle brick can occur.

Generally time-consuming nozzle brick repairs are necessary after every purge plug or sleeve change. The cleaning steps on the hot, refractory parts are dangerous and constitute heavy labour. When applying the mortar to the purge plug or to the sleeve an uneven mortar thickness can occur, or during the manually implemented mounting of the purge plug or the sleeve the mortar can become uneven in some places or even be totally stripped off locally. This leads to known problems such as premature wear in the region of the joints, the penetration of steel into the joint and even the risk of breaking through.

OBJECTS AND SUMMARY OF THE INVENTION

The object that forms the basis of the present invention is to provide an inexpensive method for the mounting and removal of a refractory purge plug or a refractory sleeve and a container for molten metal in and out of a refractory nozzle brick mounted in the container with which changing of the purge plug or the sleeve is considerably facilitated and the risk of damage to the perforated brick caused by the change is largely eliminated.

This object is achieved according to the invention by a method in which a new purge plug or a new sleeve is introduced into the nozzle brick opening and positioned and fixed in the nozzle brick opening, and thereafter, a gap between the nozzle brick opening and the purge plug or the sleeve is filled with a refractory mass, and by a container including a refractory nozzle brick mounted in a container opening, and comprising a refractory purge plug inserted into a nozzle brick opening defined by the refractory nozzle brick or a refractory sleeve forming an outlet opening, and a refractory mass arranged in a gap defined between the nozzle brick opening and the purge plug or the sleeve and which is made of a material such that it is removable for the purpose of changing the purge plug or the sleeve, and wherein the purge plug or the sleeve has a cylindrical outer surface.

Preferred further configurations of the container according to the invention and of the method according to the invention form the subject matter of the dependent claims.

Since in order to remove a worn purge plug or a worn sleeve manually implemented breaking loose, which constitutes dangerous heavy work, is no longer required, but rather these parts can easily be detached with the aid of suitable tools (drilling or milling tools), not only are the laborious cleaning steps dispensed with, but also the risk of the nozzle brick being damaged. Dispensing with the laborious cleaning and repair steps constitutes an enormous saving in time, and in addition operational safety is increased.

Moreover, the change can be automated. The problems associated with so-called mortar joints (premature wear in the joint region, the penetration of steel into the joints or even the risk of breaking through) also cease to exist. Any premature wear of the nozzle brick can be automatically restored when the purge plug or the sleeve is changed (the refractory mass filling a gap between the nozzle brick opening and the purge plug or the sleeve is also distributed over the worn regions of the nozzle brick).

BRIEF DESCRIPTION OF THE DRAWINGS

In the following the invention is described in greater detail by means of the drawings. These show as follows.

DETAILED DESCRIPTION OF THE INVENTION

Figure 1:
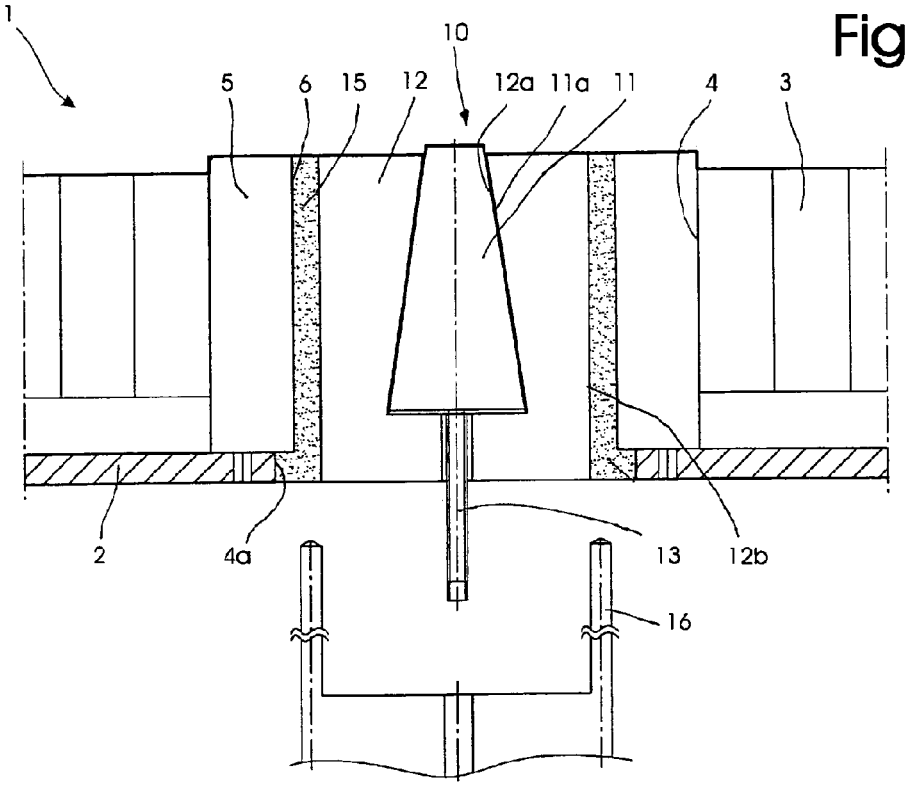
FIG. 1 shows part of a container for molten metal with a refractory nozzle brick inserted into an opening and a refractory purge plug to be replaced, mounted in the nozzle brick.
Figure 2:
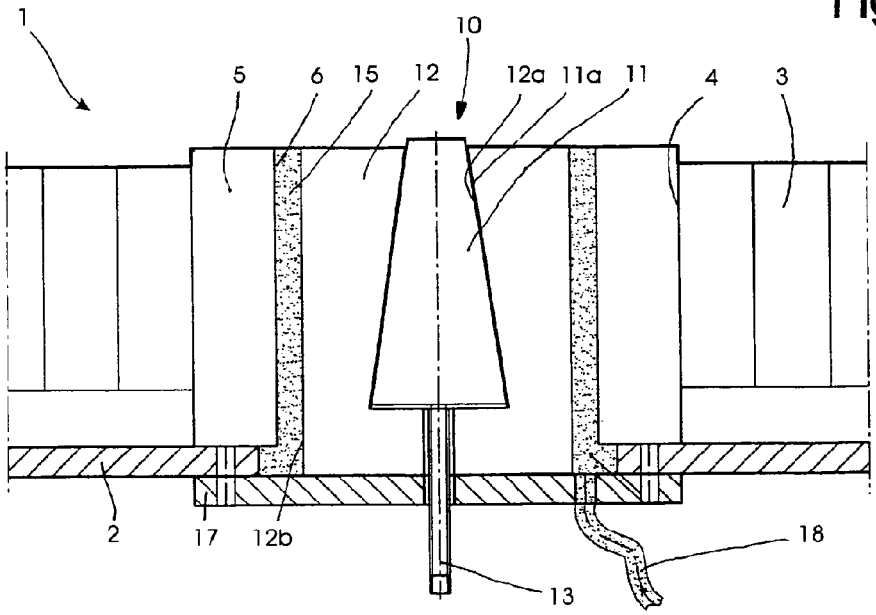
FIG. 2 shows the part of the container according to FIG. 1 with a new refractory purge plug.

In FIGS. 1 and 2 part of a container 1 for molten metal, for example a so-called ladle for molten steel, is shown, only an outer steel jacket 2 and a refractory lining 3 of the container being visible. A refractory nozzle brick 5, which has a cylindrical nozzle brick opening 6, is inserted into an opening 4 of the container 1.

According to FIGS. 1 and 2 a refractory purge plug 10, which according to the invention consists of two coaxial parts 11, 12 produced (pre-assembled) as one piece is inserted into the nozzle brick opening 6. The inner part 11 with a gas connection 13, which corresponds to a conventional purge plug, as used for introducing gas into the molten metal, has a conical outer surface 11*a*, the outer part 12 a corresponding conical inner surface 12*a*. The outer part 12, which here actually adopts the function of a conventional nozzle brick, has a cylindrical outer surface 12*b*. According to the invention, between this outer surface 12*b* and the cylindrical nozzle brick opening 6 there is an annular gap 15 which is filled with a refractory mass. The width of the gap is preferably 10 to 50 mm.

The removal of a worn purge plug is no longer implemented by means of breaking loose or chiselling out, burning out, squeezing out, pushing etc., but rather according to the invention the refractory mass is drilled out of the gap 15, and the purge plug 10 is thus released. With an annular gap 15, for this purpose conventional drills 16, e.g. core drills, can be used, as indicated in FIG. 1. By means of the drilling process one obtains a clean surface on the nozzle brick 5 and a precise geometric shape. The laborious cleaning and repair steps are dispensed with.

After the worn purge plug has been drilled out, a new purge plug 10 is introduced through an opening 4*a* in the bottom of the container 1 into the nozzle brick opening 6 by means of an appropriate apparatus (e.g. lifting tool, push rod, robot etc.) and positioned and fixed here. The mechanical placement allows precise centring here. The positioning of the new purge plug 10 in the nozzle brick opening 6 can be supported, for example, by laser measurement and/or optical methods.

As indicated in FIG. 2, a base plate 17 is then placed on the container 1, and the gap 15 is filled with the refractory mass, this being implemented preferably by means of a pump, by pouring, spraying or pushing in. In FIG. 2 the feed 18 for the refractory mass is indicated. If the nozzle brick 5 already has worn regions, no repair to the nozzle brick is required since the pumped mass is distributed evenly within the annular gap 15 and also over the worn regions of the nozzle brick 5.

Figure 3:
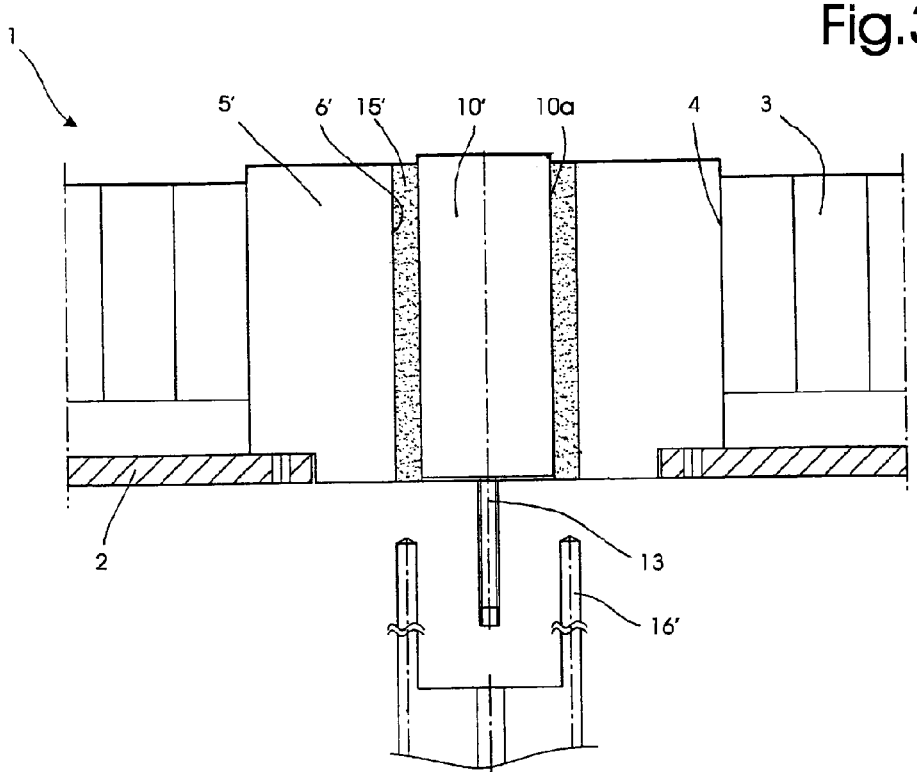
FIG. 3 is an illustration corresponding to FIG. 1 with a different variation of a refractory purge plug.

FIG. 3 shows a purge plug 10' mounted in a nozzle brick 5' which has a cylindrical outer surface 10*a*. Between this outer surface 10*a* and a cylindrical nozzle brick opening 6' of the nozzle brick 5' there is in turn a gap 15' that can be filled with a refractory mass. The mounting and removal of the purge plug 10' takes place in the same way as described above. In FIG. 3 a drilling tool 16' is in turn indicated with which the refractory mass can be drilled out in order to remove the purge plug 10' from the annular gap 15'.

The cylindrical configuration of the outer surface of the purge plug on the one hand and of the nozzle brick opening on the other hand, which produces an annular gap, is advantageous by not absolutely necessary. The gap could by all means taper conically or extend vertically, or have a rectangular horizontal cross-section, in which case one would then use milling tools such as e.g. end mills instead of drilling tools 16, 16' according to FIGS. 1 and 3 in order to remove the refractory mass.

In the same way as the purge plugs, according to the invention refractory sleeves which form an outlet opening can be mounted in corresponding openings of the containers for molten metal or in the nozzle bricks used here. These are sleeves adjacent to which respectively is the uppermost closure plate of a slide closure with which the outlet opening can be kept closed or open.

Figure 4:
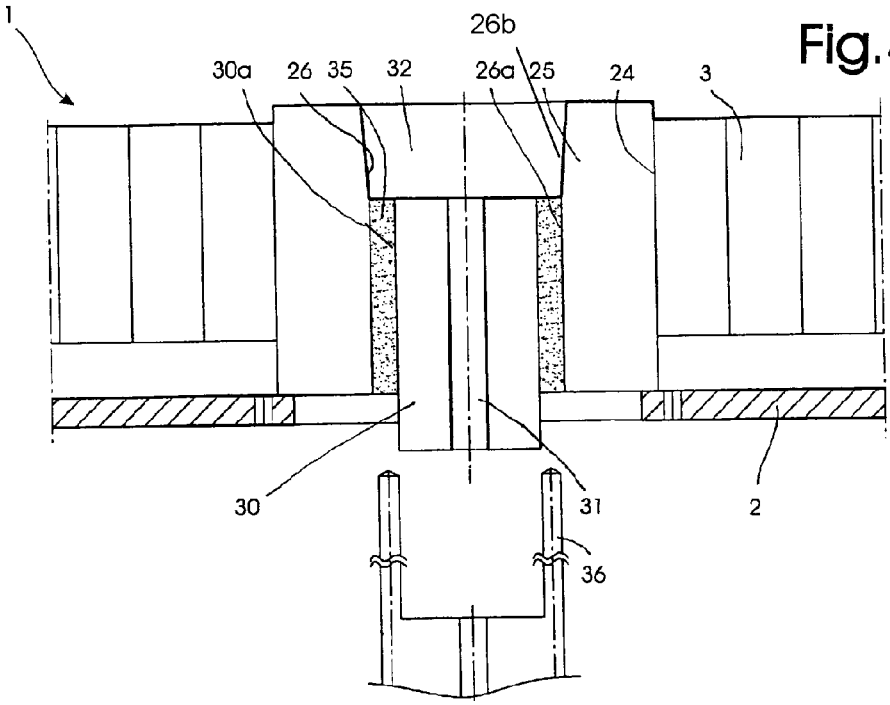
FIG. 4 shows part of a container for molten metal with a nozzle brick inserted into an opening and a refractory sleeve forming an outlet opening mounted in the nozzle brick and which is to be replaced.

FIG. 4 shows a nozzle brick 25 with a nozzle brick opening 26 mounted in an opening 24 of the container 1 for molten metal. A refractory sleeve 30, which has an outlet opening 31, is inserted into the nozzle brick opening 26. Between the nozzle brick opening 26 and a cylindrical part 26*a* of the latter and a cylindrical outer surface 30*a* of the sleeve 30 there is an annular gap 35 which is filled with a refractory mass. The nozzle brick opening 26 has an upper, conically extending part 26*b* which encloses a space 32 with an extended diameter in comparison to the sleeve 30 and its outlet opening 31.

Figure 5:
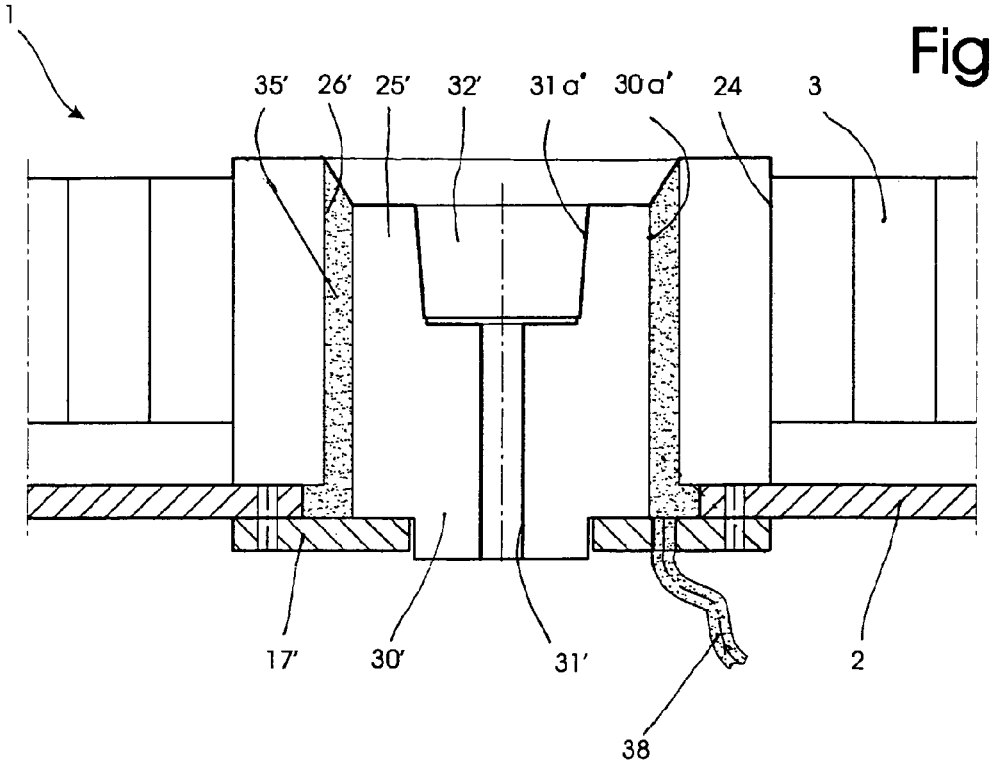
FIG. 5 shows a further embodiment of the nozzle brick and the new refractory sleeve mounted in said nozzle brick and forming an outlet opening.

With a variation shown in FIG. 5, this space 32' is provided in the sleeve 30', and the conically extending part 31*a'* is allocated to the outlet opening 31'. Between the cylindrical outer surface 30*a'* of the sleeve 30' and the cylindrical nozzle brick opening 26' there is in turn an annular gap 35' which is filled with a refractory mass. A base plate 17' is placed on the container 2.

Similarly to the purge plug 10 according to FIGS. 1 and 2 the sleeve could also consist of two coaxial parts produced (pre-assembled) as one piece, the inner of which would have a conical external shape, and the outer of which would have a corresponding conical internal shape. The outer part would then adopt the function of a conventional nozzle brick. The nozzle brick 5; 5'; 25; 25' mounted in the container forms a framing brick which guarantees the stability of the system.

The mounting and removal of the sleeves 30 and 30' according to FIGS. 4 and 5 takes place in a similar way to the mounting and removal of the purge plugs 10 and 10' according to FIGS. 1 to 3 already described. The refractory mass is advantageously removed from an annular gap with a drilling tool 36 in order to withdraw a worn sleeve (see FIG. 4). If the gap is not shaped annularly (e.g. has a rectangular horizontal cross-section), the mass is milled out. The filling of the gap around the new sleeve positioned in the nozzle brick opening is in turn preferably implemented by means of a pump, by pouring, spraying or pushing in (see feed 38 in FIG. 5).

Since manually implemented breaking loose, which constitutes dangerous heavy labour, is no longer necessary in order to remove a worn purge plug or a worn sleeve, but rather these parts can easily be detached with the aid of suitable tools (drilling or milling tools), not only can the laborious cleaning steps be dispensed with, but also the risk that the nozzle brick will be damaged. Dispensing with the laborious cleaning and repair steps also means a huge saving in time. Operational safety is increased. Moreover, the change can be automated. The problems associated with so-called mortar joints (premature wear in the joint region, penetration of steel into the joints or even the risk of breaking through) also cease to exist. Any premature wear of the nozzle brick can be automatically restored when the purge plug or the sleeve is changed (the refractory mass filling the gap between the nozzle brick opening and the purge plug or the sleeve is also distributed over the worn regions of the nozzle brick).

Removal of the refractory mass can also be implemented by burning with at least one or more lances instead of using a drill, a milling tool or the like. The refractory mass is chosen in this case such that it can be burnt out relatively easily and even in an automated manner.

The invention claimed is:

1. A method for mounting and removing a refractory purge plug or a refractory sleeve forming an outlet opening in or from a nozzle brick which is inserted into an opening of a container for molten metal and has a nozzle brick opening, the method comprising:

introducing a new purge plug or a new sleeve into the nozzle brick opening and positioning and fixing the new purge plug or the new sleeve in the nozzle brick opening, and thereafter, filling a gap between the nozzle brick opening and the purge plug or the sleeve with a refractory mass, wherein the positioning of the new purge plug or the new sleeve in the nozzle brick opening is supported by laser measurement and/or optical methods, in order to remove a worn purge plug or a worn sleeve, the refractory mass being removed from the gap such that the purge plug or the sleeve detached in this way is replaceable.

2. The method according to claim 1, wherein the refractory mass is drilled or milled out by means of a drill and/or is burnt out by means of one or more lances, from the gap between the worn purge plug or the sleeve and the nozzle brick.

3. The method according to claim 1, wherein the refractory mass is milled out from a vertically conically tapering or extending gap or a gap with a rectangular horizontal cross-section between the worn nozzle brick and the purge plug or the sleeve.

4. The method according to claim 1, wherein the introduction of the new purge plug or the new sleeve into the nozzle brick opening is implemented by an apparatus selected from a group consisting of a robot, a lifting tool and a push rod.

5. The method according to claim 1, wherein the positioning of the new purge plug or the new sleeve in the nozzle brick opening is supported by only laser measurement.

6. The method according to claim 1, wherein the gap between the nozzle brick and the new purge plug or the new sleeve is filled with the refractory mass by means of a pump, by pouring, spraying or pushing in.

7. The method according to claim 1, further comprising drilling the refractory mass out of the gap using a drill.

8. The method according to claim 1, further comprising drilling the refractory mass out of the gap using a core drill.

9. The method according to claim 1, wherein the positioning of the new purge plug or the new sleeve in the nozzle brick opening is supported by only optical methods.

10. The method according to claim 1, wherein the positioning of the new purge plug or the new sleeve in the nozzle brick opening is supported by both laser measurement and optical methods.

* * * * *